US006951493B1

(12) United States Patent
Lu

(10) Patent No.: US 6,951,493 B1
(45) Date of Patent: Oct. 4, 2005

(54) AUTOMATICALLY INFLATABLE SAFETY DEVICE

(76) Inventor: Jin-Yi Lu, 17, Lane 59, Sec. 1, Minsung Rd., Minjien Hsiang, Nantou Hsien (TW)

( * ) Notice: Subject to any disclaimer, the term of this patent is extended or adjusted under 35 U.S.C. 154(b) by 0 days.

(21) Appl. No.: 10/864,115

(22) Filed: Jun. 9, 2004

(51) Int. Cl.[7] ..... B63C 9/125
(52) U.S. Cl. ..... 441/93; 2/DIG. 3; 222/5; 441/94; 441/95
(58) Field of Search ..... 441/90, 92, 93, 441/94, 95, 106, 114–118; 222/5; 2/102, 2/462, DIG. 3

(56) References Cited

U.S. PATENT DOCUMENTS 1,782,020 A * 11/1930 Allen et al. ..... 222/5
2,028,651 A * 1/1936 Dagnall et al. ..... 222/5
2,347,010 A * 4/1944 Ward ..... 441/93
3,938,704 A * 2/1976 Milgram ..... 222/5
4,805,802 A * 2/1989 MacKendrick et al. ..... 222/5
5,921,835 A * 7/1999 Gordon et al. ..... 441/95
6,546,561 B2 * 4/2003 Duhamell ..... 2/102

FOREIGN PATENT DOCUMENTS

JP 3-121990 * 5/1991 ..... 441/41

* cited by examiner

*Primary Examiner*—Sherman Basinger
(74) *Attorney, Agent, or Firm*—Alan D. Kamrath; Nikolai & Mersereau, P.A.

(57) ABSTRACT

An automatically inflatable safety device includes an inflatable safety jacket mounted on a user's body and having an inner face formed with an air valve, and an inflation mechanism mounted on the air valve of the safety jacket to supply air into the safety jacket. Thus, the automatically inflatable safety device is available for traffic vehicles applied in the land (such as the motorcycle) and the water (such as the boat or ship), so that the automatically inflatable safety device has an amphibious effect, thereby greatly enhancing the versatility of the automatically inflatable safety device.

20 Claims, 6 Drawing Sheets

AUTOMATICALLY INFLATABLE SAFETY DEVICE

BACKGROUND OF THE INVENTION

1. Field of the Invention

The present invention relates to an automatically inflatable safety device, and more particularly to an automatically inflatable safety device for use in the land and the water.

2. Description of the Related Art

A conventional automatically inflatable safety device comprises an inflatable safety jacket mounted on a user's body and having an inner face formed with an air valve, and an inflation mechanism mounted on the air valve of the safety jacket to supply air into the safety jacket. In practice, when the user is riding the motorcycle, the inflatable safety jacket is put on the user's body, and the inflation mechanism has a connecting ring fastened on the motorcycle. When the user is thrown out of the motorcycle due to an accident, the connecting ring is pulled outward to open the inflation mechanism to release the hydraulic gas contained in the inflation mechanism. Then, the hydraulic gas contained in the inflation mechanism flows into the air valve of the safety jacket to inflate the safety jacket instantaneously so as to protect the user's body.

SUMMARY OF THE INVENTION

In accordance with the present invention, there is provided an automatically inflatable safety device, comprising an inflatable safety jacket having an inner face formed with an air valve, and an inflation mechanism mounted on the air valve of the safety jacket, wherein:

the inflation mechanism includes:

a hollow main body having an inside formed with a stepped receiving chamber and having a periphery formed with a hollow inflation seat communicating with the receiving chamber of the main body, an inflation nozzle protruded from and connected to an inside of the inflation seat and having a distal end inserted into the air valve of the safety jacket and a passage communicating with the receiving chamber of the main body;

an air tank mounted on the inflation seat;

a firing pin movably mounted in the inflation seat and having a first end movable into the air tank and formed with a plurality of slits;

a drive shaft movably mounted in the receiving chamber of the main body to drive the firing pin to move toward the air tank and having a first end formed with two opposite locking portions;

a retaining ring rotatably mounted in the receiving chamber of the main body and having an inner wall formed with two opposite stop portions each detachably locked on a respective one of the two locking portions of the drive shaft; and a pull wire wound around a periphery of the retaining ring to rotate the retaining ring and having a first end secured on the retaining ring and a second end protruding outward from the passage of the main body.

The primary objective of the present invention is to provide an automatically inflatable safety device that is available for traffic vehicles applied in the land (such as the motorcycle) and the water (such as the boat or ship).

Another objective of the present invention is to provide an automatically inflatable safety device having an amphibious effect, thereby greatly enhancing the versatility of the automatically inflatable safety device.

A further objective of the present invention is to provide an automatically inflatable safety device that is inflated instantaneously in a rapid and exact manner so as to protect a user exactly safely.

Further benefits and advantages of the present invention will become apparent after a careful reading of the detailed description with appropriate reference to the accompanying drawings.

DETAILED DESCRIPTION OF THE INVENTION

Figure 1:
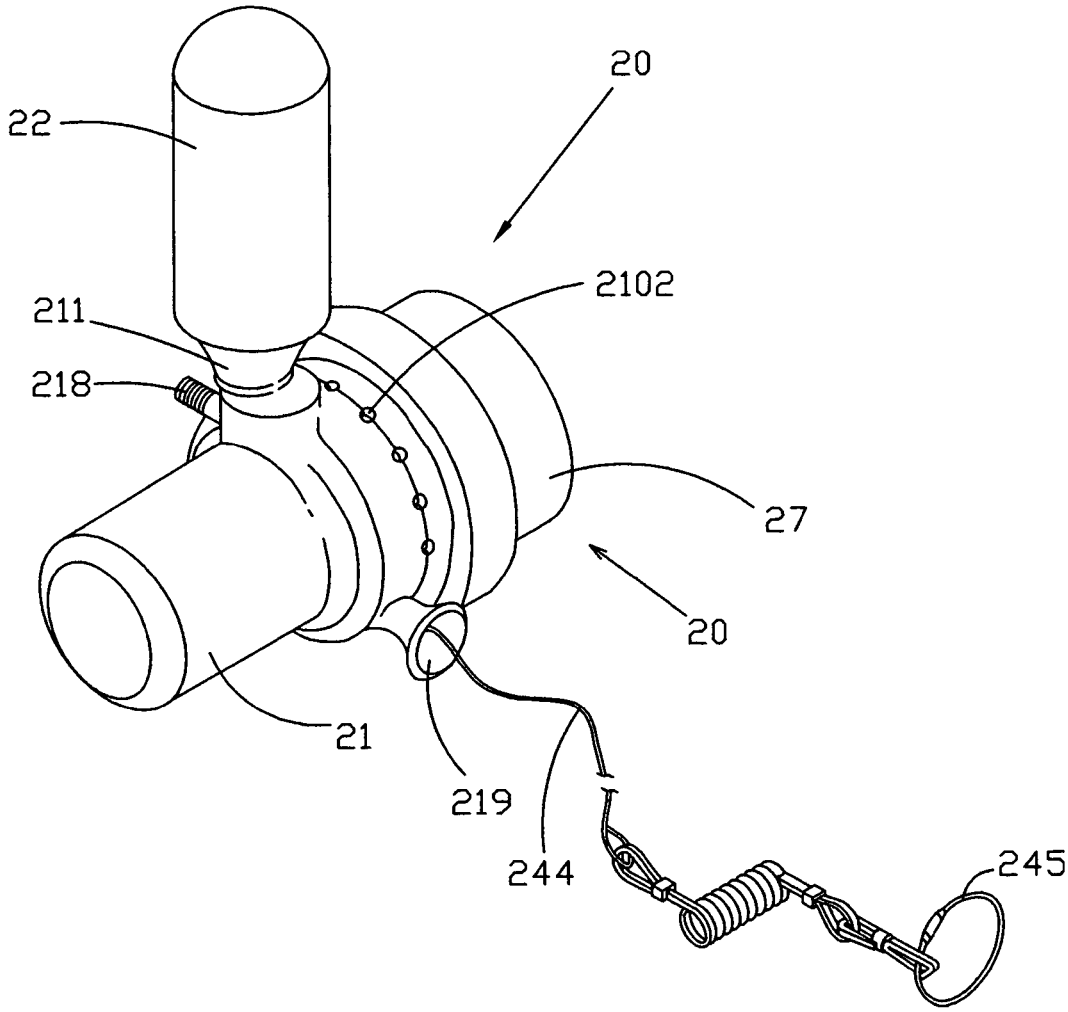
FIG. 1 is a perspective view of an automatically inflatable safety device in accordance with the preferred embodiment of the present invention.

Referring to the drawings and initially to FIGS. 1–4, an automatically inflatable safety device in accordance with the preferred embodiment of the present invention comprises an inflatable safety jacket 10 mounted on a user's body and having an inner face formed with an air valve 11, and an inflation mechanism 20 mounted on the air valve 11 of the safety jacket 10 to supply air into the safety jacket 10.

The inflation mechanism 20 includes a hollow main body 21 having an inside formed with a stepped receiving chamber 210 and having a periphery formed with a hollow inflation seat 211 communicating with the receiving chamber 210 of the main body 21, an inflation nozzle 218 protruded from and connected to an inside of the inflation seat 211 and having a distal end inserted into the air valve 11 of the safety jacket 10 and a passage 219 communicating with the receiving chamber 210 of the main body 21, an air tank 22 mounted on the inflation seat 211 and containing a high-pressure hydraulic gas, a firing pin 213 movably mounted in the inflation seat 211 and having a first end movable into the air tank 22 and formed with a plurality of slits 2130 to allow passage of the hydraulic gas contained in the air tank 22, a drive shaft 23 movably mounted in the receiving chamber 210 of the main body 21 to drive the firing pin 213 to move toward the air tank 22 and having a first end formed with two opposite locking portions 235, a retaining ring 24 rotatably mounted in the receiving chamber 210 of the main body 21 and having an inner wall formed with two opposite stop portions 241 each detachably locked on a respective one of the two locking portions 235 of the drive shaft 23, and a pull wire 244 wound around a periphery of the retaining ring 24 to rotate the retaining ring 24 and having a first end secured on the retaining ring 24 and a second end protruding outward from the passage 219 of the main body 21.

The receiving chamber 210 of the main body 21 has a first end formed with an opened wall formed with a plurality of through holes 2102 each communicating with the receiving chamber 210 of the main body 21 and a second end formed with a closed wall formed with two opposite guide rails 2100. The opened wall of the receiving chamber 210 of the main body 21 is formed with an annular locking groove 2104.

The first end of the drive shaft 23 has a periphery formed with an annular flange 234, and the two locking portions 235 of the drive shaft 23 are mounted on the flange 234 in an oblique manner. The drive shaft 23 has a second end having an inside formed with a mounting recess 231 and a periphery formed with two opposite guide slots 233. Each of the two guide rails 2100 of the main body 21 is slidably mounted in a respective one of the two guide slots 233 of the drive shaft 23. The inflation mechanism 20 further includes an elastic member 232 mounted in the receiving chamber 210 of the main body 21 and urged between the second end of the drive shaft 23 and the main body 21. Preferably, the elastic member 232 is mounted in the mounting recess 231 of the drive shaft 23. The drive shaft 23 has a tapered outer wall having a thickness gradually increased from the first end to the second end of the drive shaft 23.

The inside of the inflation seat 211 is formed with a threaded stepped receiving hole 2110 communicating with the inflation nozzle 218 for mounting the firing pin 213, and the inflation mechanism 20 further includes a threaded sealing cover 216 screwed into the receiving hole 2110 of the inflation seat 211 and formed with a through hole 217 to allow passage of the firing pin 213, an urging spring 215 mounted in the receiving hole 2110 of the inflation seat 211 and urged between the sealing cover 216 and the firing pin 213 to press the firing pin 213 toward the drive shaft 23, an urging ball 212 mounted in the receiving chamber 210 of the main body 21 and urged between a second end of the firing pin 213 and the tapered outer wall of the drive shaft 23, and an O-ring 214 mounted on a periphery of the firing pin 213 and urged on the receiving hole 2110 of the inflation seat 211. Preferably, the sealing cover 216 has a periphery formed with two spaced insertion holes 2160 for insertion of two tools, such as sticks (not shown), to facilitate rotation of the sealing cover 216. In addition, the firing pin 213 has a mediate portion formed with a shoulder 2132 rested on the urging spring 215, and the second end of the firing pin 213 is formed with a semi-spherical recess 2134 for mounting the urging ball 212.

The retaining ring 24 is rotatably mounted on the flange 234 of the drive shaft 23. Each of the two stop portions 241 of the retaining ring 24 is substantially V-shaped. The retaining ring 24 has a side formed with two opposite protruding locking blocks 242 and has an outer wall formed with an annular groove 243 for mounting the pull wire 244. In addition, the second end of the pull wire 244 is connected to a loop 245 which is fastened on a traffic vehicle, such as the motorcycle or the like.

The inflation mechanism 20 further includes a drive ring 25 rotatably mounted in the receiving chamber 210 of the main body 21 for rotating the retaining ring 24 and having a first side formed with two opposite protruding drive blocks 251 engaged with the two locking blocks 242 of the retaining ring 24, a water solvable wire 253 wound around a periphery of the drive ring 25 and urged on a wall of the receiving chamber 210 of the main body 21 to releasably fix the drive ring 25 in the receiving chamber 210 of the main body 21, an end cap 27 mounted on the opened wall of the receiving chamber 210 of the main body 21, and a torsion spring 26 mounted in the end cap 27 and biased between the end cap 27 and the drive ring 25 to rotate the drive ring 25.

Figure 4:
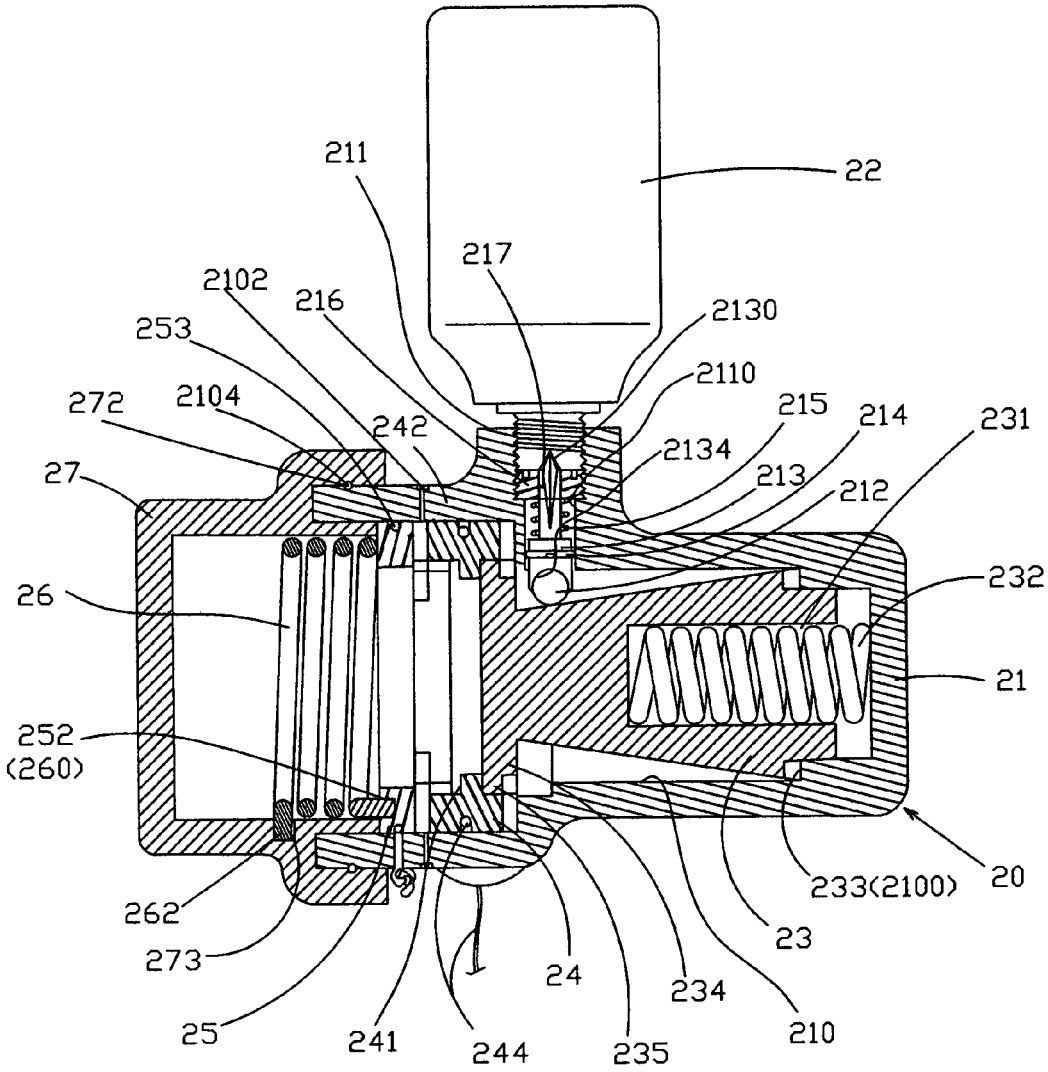
FIG. 4 is a plan cross-sectional view of the automatically inflatable safety device as shown in FIG. 1.

The water solvable wire 253 has a first end fixed on the periphery of the drive ring 25 and a second end extended from the inner wall to the outer wall of the main body 21 and fixed to the main body 21 as shown in FIG. 4.

The end cap 27 has an opened end mounted on the main body 21 and formed with an annular locking groove 271, and the inflation mechanism 20 further includes a snap ring 272 mounted in the locking groove 271 of the end cap 27 and the locking groove 2104 of the main body 21.

The drive ring 25 has a second side formed with a locking hole 252 (see FIG. 4), the end cap 27 has an inner wall formed with a locking bore 273, and the torsion spring 26 has a first end 260 mounted in the locking hole 252 of the drive ring 25 and a second end 262 mounted in the locking bore 273 of the end cap 27. Thus, when the end cap 27 is rotate, the torsion spring 26 stores an elastic force, so that the drive ring 25 is pulled by the water solvable wire 253 to store a dynamic energy of rotation, and the two drive blocks 251 of the drive ring 25 are engaged with the two locking blocks 242 of the retaining ring 24.

Figure 2:
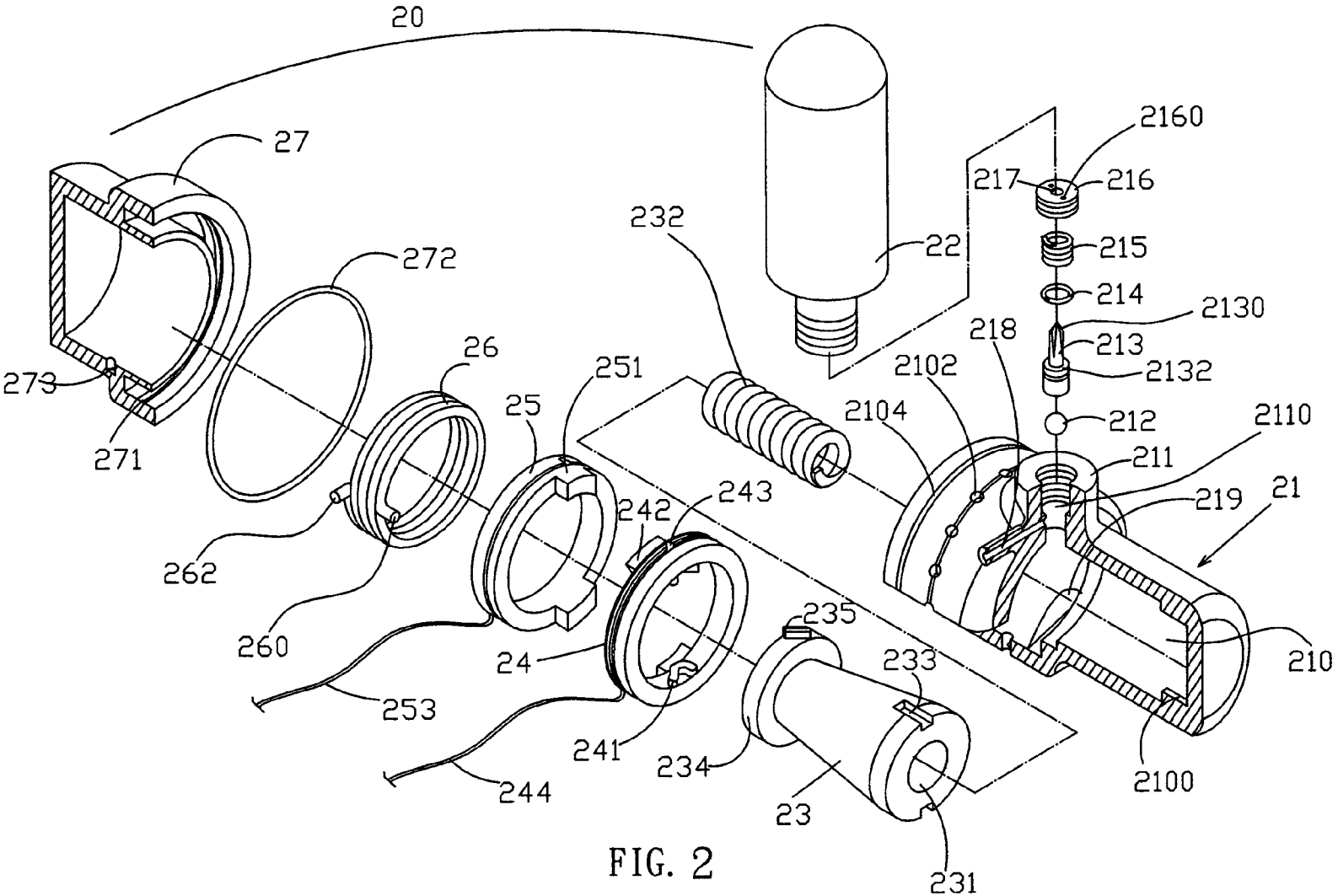
FIG. 2 is an exploded perspective view of the automatically inflatable safety device as shown in FIG. 1.
Figure 3:
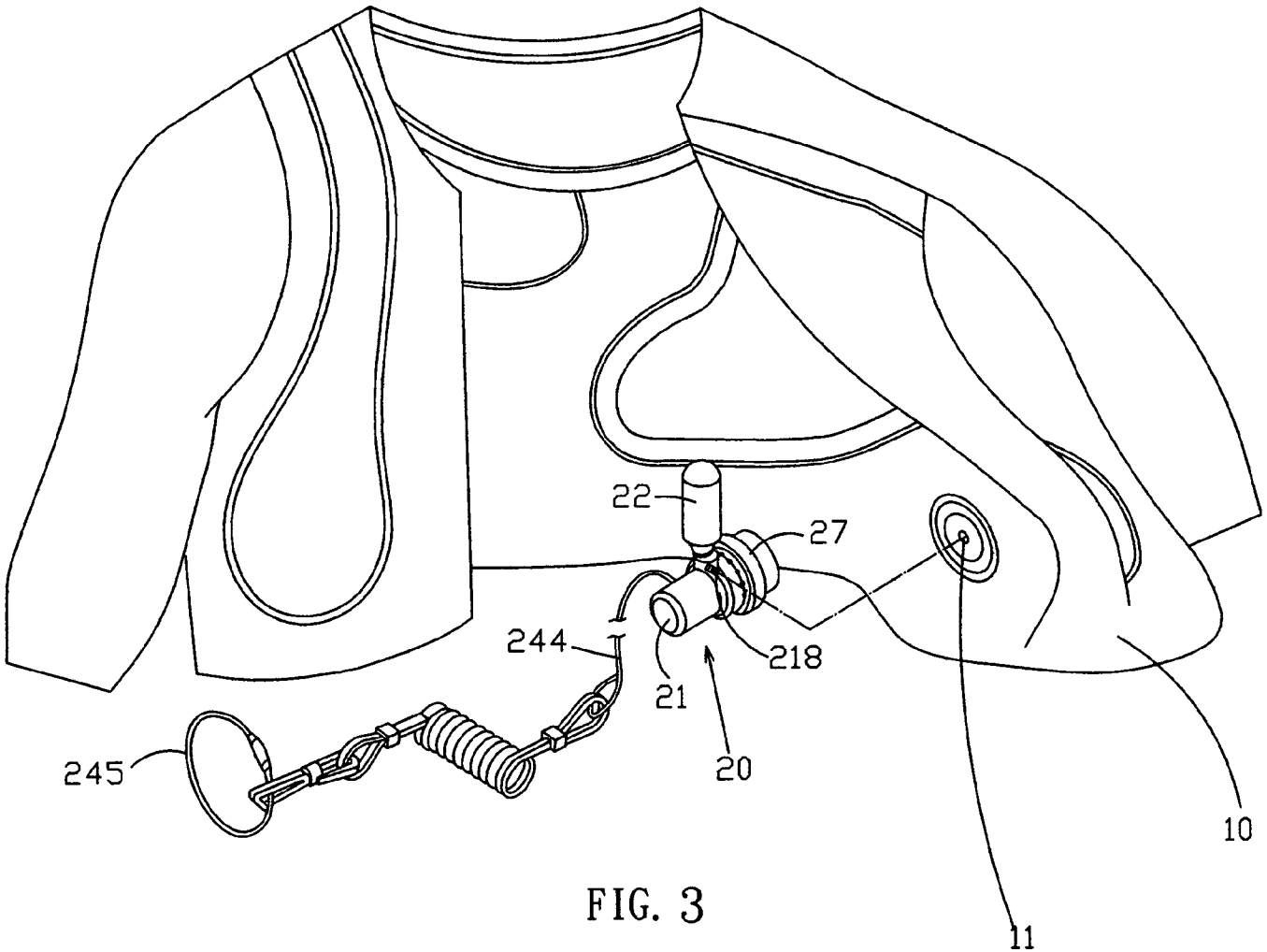
FIG. 3 is a perspective view of the automatically inflatable safety device as shown in FIG. 1.
Figure 5:
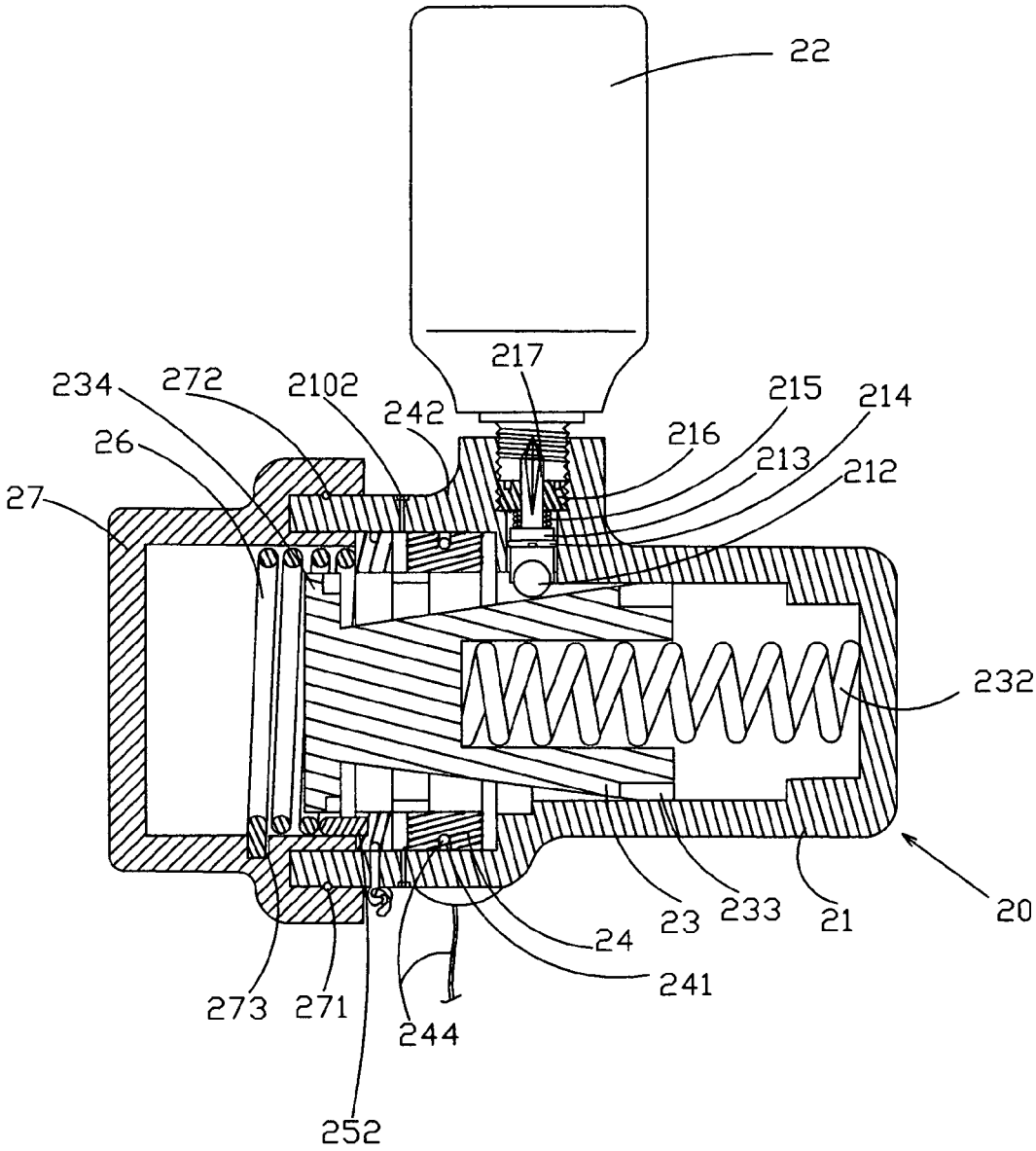
FIG. 5 is a schematic operational view of the automatically inflatable safety device as shown in FIG. 4 in use.

In operation, referring to FIGS. 4 and 5 with reference to FIGS. 1–3, when a user is riding the motorcycle, the inflatable safety jacket 10 is put on the user's body, and the loop 245 of the pull wire 244 of the inflation mechanism 20 is fastened on the motorcycle. When the user is thrown out of the motorcycle due to an accident, the pull wire 244 is pulled outward with the human body to drive and rotate the retaining ring 24 which moves the stop portions 241 to detach from the locking portions 235 of the drive shaft 23, thereby releasing the drive shaft 23 from the retaining ring 24, so that the drive shaft 23 is movable freely in the receiving chamber 210 of the main body 21. Then, the drive shaft 23 is pushed by the restoring force of the elastic member 232 to move toward the end cap 27, so that the drive shaft 23 is moved from the position as shown in FIG. 4 to the position as shown in FIG. 5. At this time, the urging ball 212 is pressed by the tapered outer wall of the drive shaft 23 to move outward to press the firing pin 213 to move toward the air tank 22, so that the first end of the firing pin 213 is moved into the air tank 22 to pierce a protective film (not shown) mounted in the air tank 22 so as to release the hydraulic gas contained in the air tank 22. Then, the hydraulic gas contained in the air tank 22 flows through the through hole 217 of the sealing cover 216, the slits 2130 of the firing pin 213, the receiving hole 2110 of the inflation seat 211 and the inflation nozzle 218 into the air valve 11 of the safety jacket 10 to inflate the safety jacket 10 instantaneously so as to protect the user's body.

Figure 6:
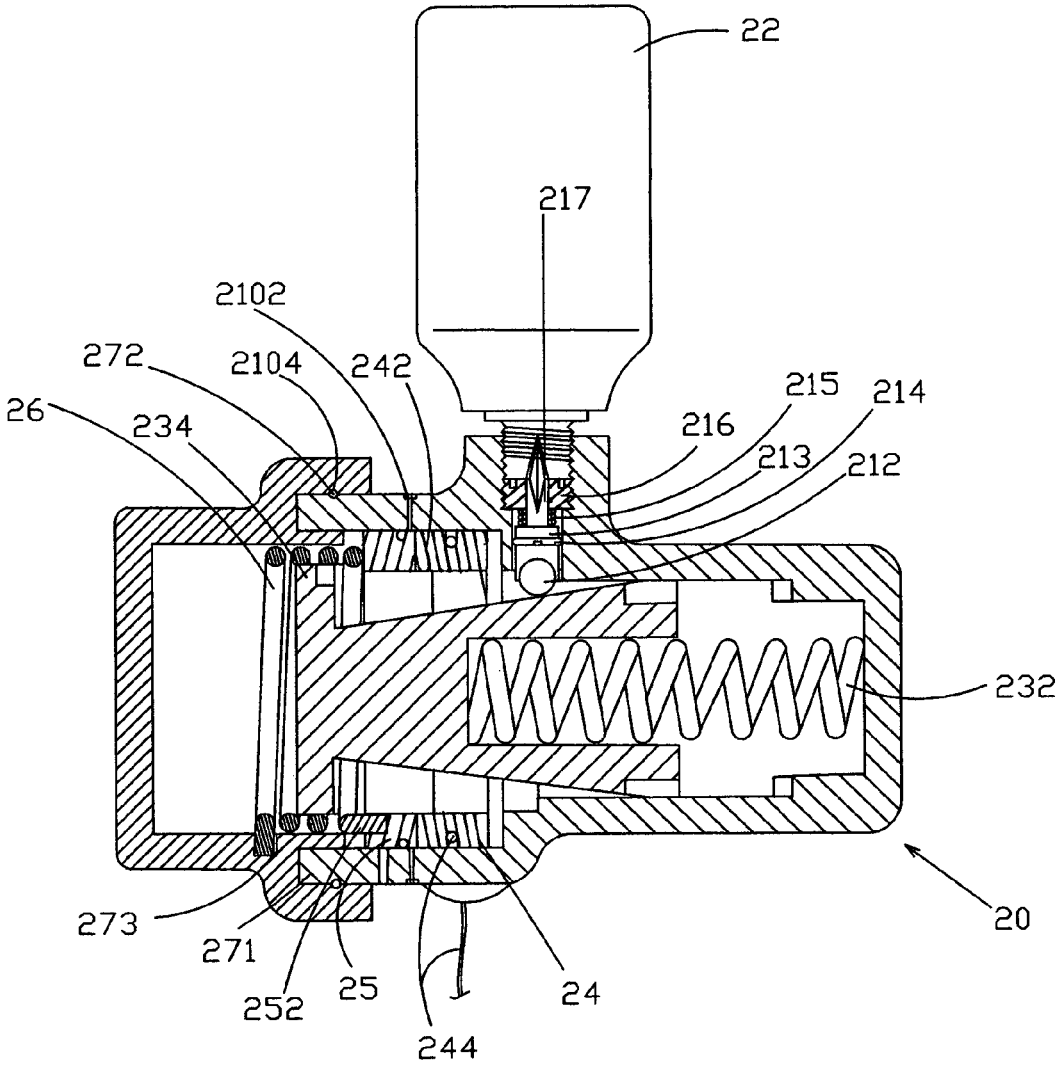
FIG. 6 is a schematic operational view of the automatically inflatable safety device as shown in FIG. 4 in use.

Alternatively, referring to FIGS. 4 and 6 with reference to FIGS. 1–3, when a user is placed in a boat or a ship, the inflatable safety jacket 10 is put on the user's body. When the user is thrown out of the boat due to an accident, the inflation mechanism 20 falls into the water with the human body. Then, the water penetrates through the through holes 2102 of the main body 21 into the receiving chamber 210 of the main body 21, so that the water solvable wire 253 is dissolved in the water. In such a manner, the drive ring 25 is released from the water solvable wire 253, so that the drive ring 25 is rotatable freely in the receiving chamber 210 of the main body 21. Then, the drive ring 25 is rotated by the restoring force of the torsion spring 26 to move the drive blocks 251 which move the locking blocks 242 of the retaining ring 24, so that the retaining ring 24 is rotated to move the stop portions 241 to detach from the locking portions 235 of the drive shaft 23, thereby releasing the drive shaft 23 from the retaining ring 24, so that the drive shaft 23 is movable freely in the receiving chamber 210 of the main body 21. Then, the drive shaft 23 is pushed by the restoring force of the elastic member 232 to move toward the end cap 27, so that the drive shaft 23 is moved from the position as shown in FIG. 4 to the position as shown in FIG. 6. At this time, the urging ball 212 is pressed by the tapered outer wall of the drive shaft 23 to move outward to press the firing pin 213 to move toward the air tank 22, so that the first end of the firing pin 213 is moved into the air tank 22 to pierce the protective film mounted in the air tank 22 so as to release the hydraulic gas contained in the air tank 22. Then, the hydraulic gas contained in the air tank 22 flows through the through hole 217 of the sealing cover 216, the slits 2130 of the firing pin 213, the receiving hole 2110 of the inflation seat 211 and the inflation nozzle 218 into the air valve 11 of the safety jacket 10 to inflate the safety jacket 10 instantaneously so as to protect the user's body by the buoyant force applied by the safety jacket 10.

Accordingly, the automatically inflatable safety device is available for traffic vehicles applied in the land and the water, so that the automatically inflatable safety device has an amphibious effect, thereby greatly enhancing the versatility of the automatically inflatable safety device. In addition, the automatically inflatable safety device is inflated instantaneously in a rapid and exact manner so as to protect a user exactly safely.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An automatically inflatable safety device, comprising an inflatable safety jacket having an inner face formed with an air valve, and an inflation mechanism mounted on the air valve of the safety jacket, wherein:

the inflation mechanism includes:

a hollow main body having an inside formed with a stepped receiving chamber and having a periphery formed with a hollow inflation seat communicating with the receiving chamber of the main body, an inflation nozzle protruded from and connected to an inside of the inflation seat and having a distal end inserted into the air valve of the safety jacket and a passage communicating with the receiving chamber of the main body;

an air tank mounted on the inflation seat;

a firing pin movably mounted in the inflation seat and having a first end movable into the air tank and formed with a plurality of slits;

a drive shaft movably mounted in the receiving chamber of the main body to drive the firing pin to move toward the air tank and having a first end formed with two opposite locking portions;

a retaining ring rotatably mounted in the receiving chamber of the main body and having an inner wall formed with two opposite stop portions each detachably locked on a respective one of the two locking portions of the drive shaft; and a pull wire wound around a periphery of the retaining ring to rotate the retaining ring and having a first end secured on the retaining ring and a second end protruding outward from the passage of the main body.

2. The automatically inflatable safety device in accordance with claim 1, wherein the first end of the drive shaft has a periphery formed with an annular flange, the two locking portions of the drive shaft are mounted on the flange in an oblique manner, and the retaining ring is rotatably mounted on the flange of the drive shaft.

3. The automatically inflatable safety device in accordance with claim 1, wherein the inflation mechanism further includes an elastic member mounted in the receiving chamber of the main body and urged between a second end of the drive shaft and the main body.

4. The automatically inflatable safety device in accordance with claim 3, wherein the second end of the drive shaft has an inside formed with a mounting recess, and the elastic member is mounted in the mounting recess of the drive shaft.

5. The automatically inflatable safety device in accordance with claim 3, wherein the drive shaft has a tapered outer wall having a thickness gradually increased from the first end to the second end of the drive shaft.

6. The automatically inflatable safety device in accordance with claim 1, wherein the drive shaft has a second end having a periphery formed with two opposite guide slots, and the receiving chamber of the main body has an end formed with two opposite guide rails each slidably mounted in a respective one of the two guide slots of the drive shaft.

7. The automatically inflatable safety device in accordance with claim 1, wherein the inside of the inflation seat is formed with a threaded stepped receiving hole communicating with the inflation nozzle for mounting the firing pin, and the inflation mechanism further includes a threaded sealing cover screwed into the receiving hole of the inflation seat and formed with a through hole to allow passage of the firing pin, an urging spring mounted in the receiving hole of the inflation seat and urged between the sealing cover and the firing pin to press the firing pin toward the drive shaft, and an urging ball mounted in the receiving chamber of the main body and urged between a second end of the firing pin and the tapered outer wall of the drive shaft.

8. The automatically inflatable safety device in accordance with claim 7, wherein the inflation mechanism further includes an O-ring mounted on a periphery of the firing pin and urged on the receiving hole of the inflation seat.

9. The automatically inflatable safety device in accordance with claim 7, wherein the sealing cover has a periphery formed with two spaced insertion holes.

10. The automatically inflatable safety device in accordance with claim 7, wherein the firing pin has a mediate portion formed with a shoulder rested on the urging spring.

11. The automatically inflatable safety device in accordance with claim 7, wherein the second end of the firing pin is formed with a semi-spherical recess for mounting the urging ball.

12. The automatically inflatable safety device in accordance with claim 1, wherein each of the two stop portions of the retaining ring is substantially V-shaped.

13. The automatically inflatable safety device in accordance with claim 1, wherein the retaining ring has a side formed with two opposite protruding locking blocks, and the inflation mechanism further includes a drive ring rotatably mounted in the receiving chamber of the main body for rotating the retaining ring and having a first side formed with two opposite protruding drive blocks engaged with the two locking blocks of the retaining ring, a water solvable wire wound around a periphery of the drive ring and urged on a wall of the receiving chamber of the main body to releasably fix the drive ring in the receiving chamber of the main body, an end cap mounted on the opened wall of the receiving chamber of the main body, and a torsion spring mounted in the end cap and biased between the end cap and the drive ring to rotate the drive ring.

14. The automatically inflatable safety device in accordance with claim 13, wherein the receiving chamber of the main body has an end formed with an annular locking groove, the end cap has an opened end mounted on the main body and formed with an annular locking groove, and the inflation mechanism further includes a snap ring mounted in the locking groove of the end cap and the locking groove of the main body.

15. The automatically inflatable safety device in accordance with claim 13, wherein the drive ring has a second side formed with a locking hole, the end cap has an inner wall formed with a locking bore, and the torsion spring has a first end mounted in the locking hole of the drive ring and a second end mounted in the locking bore of the end cap.

16. The automatically inflatable safety device in accordance with claim 1, wherein the water solvable wire has a first end fixed on the periphery of the drive ring and a second end extended from the inner wall to the outer wall of the main body and fixed to the main body.

17. The automatically inflatable safety device in accordance with claim 1, wherein the retaining ring has an outer wall formed with an annular groove for mounting the pull wire.

18. The automatically inflatable safety device in accordance with claim 1, wherein the second end of the pull wire is connected to a loop.

19. The automatically inflatable safety device in accordance with claim 1, wherein the main body has an outer wall formed with a plurality of through holes each communicating with the receiving chamber of the main body.

20. The automatically inflatable safety device in accordance with claim 1, wherein the receiving chamber of the main body has a first end formed with an opened wall and a second end formed with a closed wall.

* * * * *